United States Patent [19]

Moebus et al.

[11] 4,044,944

[45] Aug. 30, 1977

[54] CENTRIFUGE

[75] Inventors: Bernhard Moebus, Waiblingen, Germany; Gerhard Larch, St. Marienkirchen, Austria; Rudolf Friedrich, Pocking, Germany

[73] Assignee: Fa. Moebus KG., Stuttgart, Germany

[21] Appl. No.: 667,548

[22] Filed: Mar. 17, 1976

[30] Foreign Application Priority Data

Apr. 24, 1975 Germany ..... 2518206

[51] Int. Cl.[2] ..... B04B 1/14; B04B 11/04

[52] U.S. Cl. ..... 233/20 A

[58] Field of Search ..... 233/19 R, 19 A, 20 R, 233/20 A, 27, 28

[56] References Cited

U.S. PATENT DOCUMENTS

| | | | |
|---|---|---|---|
| 2,661,150 | 12/1953 | Abbott | 233/27 |
| 3,167,509 | 1/1965 | Steinacker | 233/19 R |
| 3,630,431 | 12/1971 | Oka | 233/20 A |
| 3,747,840 | 7/1973 | Weiland | 233/20 R |
| 3,797,737 | 3/1974 | Kadotani et al. | 233/27 |

FOREIGN PATENT DOCUMENTS

| | | | |
|---|---|---|---|
| 887,232 | 8/1943 | France | 233/20 A |

*Primary Examiner*—George H. Krizmanich

[57] ABSTRACT

A centrifuge for separating and/or thickening liquid/-solid mixtures. The centrifuge has a radially outwardly tapered centrifuging chamber which is defined by an axially movable hollow cylindrical member and two conical drum members rigidly mounted on the horizontal centrifuge shaft in spaced relationship to each other. The centrifuging chamber can be opened or closed by axially moving the hollow cylindrical member across an ejection gap which is formed by the two conical drum members.

12 Claims, 3 Drawing Figures

CENTRIFUGE

BACKGROUND OF THE INVENTION

The invention pertains to a centrifuge for separating and/or thickening of liquid/solid mixtures. The centrifuging chamber is generally radially outwardly tapered. Its radial inward side is generally formed by the main shaft of the centrifuge and its lateral sides are generally defined by conically shaped drum members. The centrifuging chamber is usually opened or closed by means of a closing body slidable in an axial direction. Centrifuges of the afore-described type are already known in the art (see for example German published application No. 1,951,588, German utility model No. 1,858,587, and German utility model No. 7,241,808). In centrifuges of the state of the art, the removal of the solid particles which have been flung outwardly by the centrifuge, is effected by axially sliding one of the two conically shaped drum members relative to the other, thereby opening the centrifuging chamber. The known centrifuges which open in this way have the drawback that, when largely varying flow rates are required, the sizes of several parts of the centrifuge must be proportionally changed which makes the mass production of centrifuges for different flow rates more costly.

SUMMARY OF THE INVENTION

The invention has as its main object to provide a centrifuge construction which is reliable in operation and is relatively inexpensive to construct and can be inexpensively mass produced in widely different sizes.

This object of the invention is obtained by providing a centrifuge construction in which both drum members are rigidly mounted, in spaced relationship to each other, on the horizontally supported centrifuge shaft thereby defining a centrifuging chamber therebetween. An ejection gap is formed between the two drum members and this gap can be closed by means of a concentric, axially slidably mounted, hollow cylindrical body. Both drum bodies have stop surfaces cooperating with the hollow cylindrical body to limit its axial movement. The rigidly mounted drum bodies may be directly abutted by separating rings which determine the distance therebetween. Alternately the drum bodies can be mounted on the shaft so as to be in direct contact with shoulders on the shaft of the centrifuge. Furthermore, the hollow axially movable cylindrical body can be supported on one or both of the drum members.

The construction of the centrifuge in accordance with the invention permits mass production of centrifuges of different sizes without changing a major part of the members forming the assembly of the centrifuge. Thus, for example, the centrifuging chamber can be enlarged by increasing the distance between the drum members, rigidly mounted on a very rugged shaft, and by correspondingly increasing the length of the hollow cylindrical body. The shaft diameter is preferably equal to at least a third of the maximum diameter of the centrifuging chamber. This feature makes it possible to use the shaft not only for centrifuges having differently sized centrifuging chambers, but in addition thereto, the relatively large shaft diameter makes it possible that the outlets of the channels extending through the centrifuge shaft are located in a region having a relatively large peripheral speed.

The hollow cylinder body which closes and opens the ejection gap can be mechanically, pneumatically or hydraulically actuated. A pressure chamber may be advantageously provided between the drum member and hollow cylinder body which serves to adjust the hollow cylinder body by axially moving it by means of a pressure medium. The hollow cylinder body can also be spring-biased in one adjusting direction, whereby advantageously a plurality of pressure springs are uniformly spaced around the centrifuge at a distance from the axis thereof, such springs providing a uniform force distribution over the periphery of the hollow cylinder body.

Preferably the hollow cylinder body is adjusted hydraulically, whereby there are provided two oppositely acting pressure chambers having different axial pressure surfaces and being disposed between one of the drum members and hollow cylinder body. The two pressure chambers are advantageously provided with radially inwardly disposed inlet openings through which an hydraulic pressure medium can be supplied. It should be noted that small pressures, for example a normal house waterline pressure is sufficient, since the hydraulic pressure medium is forced by centrifugal force effect into the pressure chambers. Furthermore, there are barely any axial force components acting on the hollow cylinder body, so that it can be easily guided and moved.

A further advantage, having in mind the desired efficacy and reliability of the centrifuge, can be obtained by reducing the volume of the centrifuging chamber and by arranging a sleeve on the main shaft, which is formed in such a way that, when moving the drum members apart the inlet openings for the mixture to be treated are closed, whereas the outlet openings for the clarified or treated liquid remain open, so that the expanding sleeve interrupts the flow of liquid into the centrifuge and simultaneously therewith the liquid present in the centrifuging chamber can be displaced and exit through the outlet openings. Consequently, when opening the centrifuge proper there is practically only solid material flung outwardly through the expelling gap.

Since the volume of the centrifuging chamber can be adjusted by simply changing the distance between both drum members on the centrifuge shaft, the centrifuge in accordance with the invention can be adapted for different specific weights of solid materials in the to be treated slurries. The centrifuge of the invention also permits variations in operating speeds, i.e. the number of revolutions per minute, in particular when the conical drum members are made out of welded steel. Thus the centrifuge can be used for treating industrial effluents or communal bath effluents because it can selectively be adjusted for different solid material components.

BRIEF DESCRIPTION OF THE DRAWING

The invention is further set forth in the following detailed description taken in conjunction with the appended drawing, in which the following is illustrated.

DETAILED DESCRIPTION

Figure 1A:
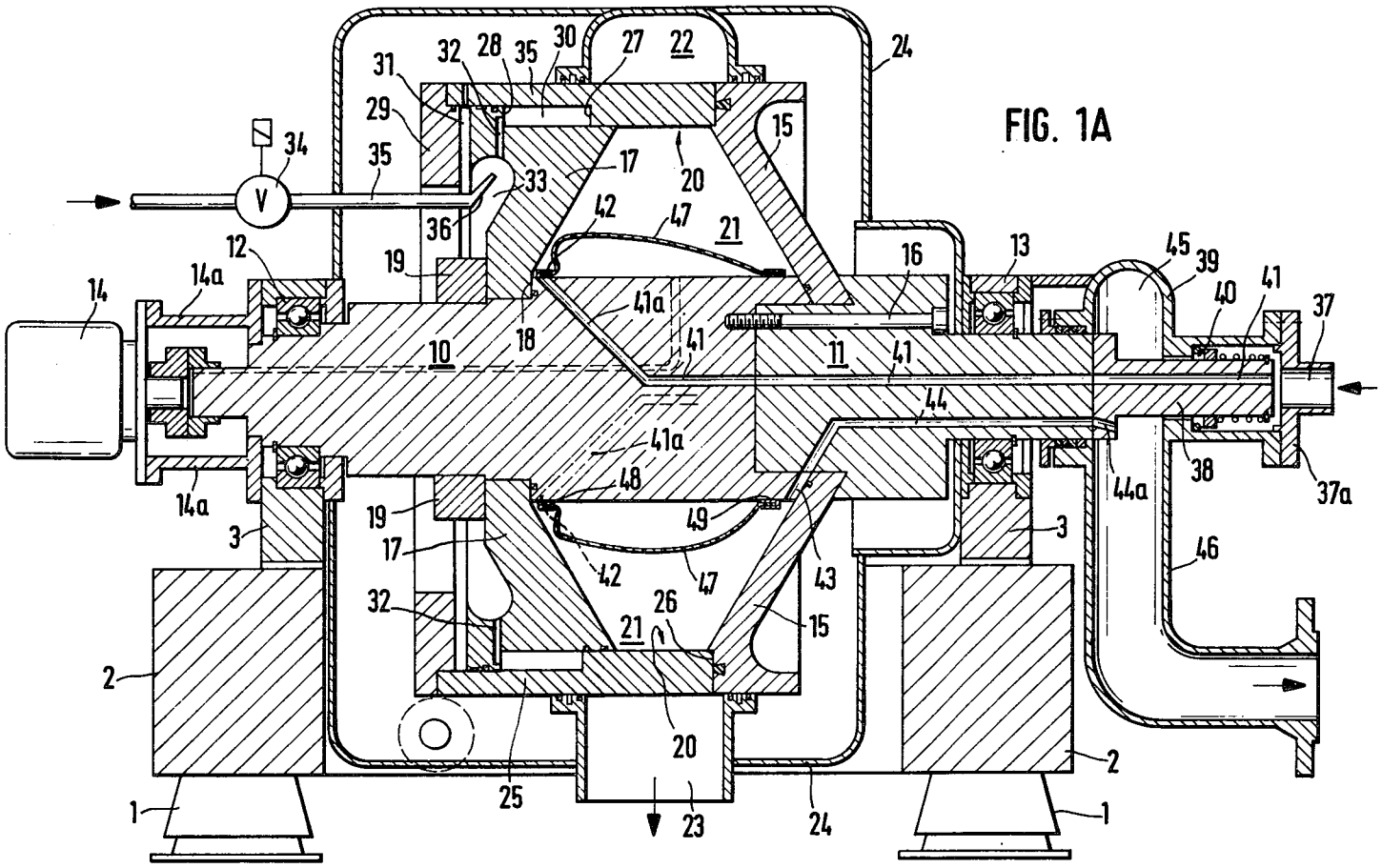
FIG. 1A is a schematic central longitudinal section of a centrifuge in accordance with the invention wherein the centrifuging chamber is closed.

The centrifuge illustrates in FIG. 1 has a main frame 2 which is supported on a pair of columns 1. A pair of A-frames 3 housing roller bearings 12, 13 rotatably support a shaft having a relatively large diameter. The shaft is made up of two sections 10 and 11 which are respectively rotatably supported by the spaced roller bearings 12 and 13. The shaft is driven by means of a motor 14 which is axially mounted on the centrifuge by means of a pair of flanges 14a bolted or otherwise suitably connected to the A-frame 3. A first conical drum member 15, made of welded steel, is axially, rigidly mounted on the shaft and clamped between the shaft sections 10 and 11. The drum member 15 is secured in place by means of a plurality of threaded bolts 16 (only one of which is illustrated) which serve to clamp the drum member 15 between the shaft sections 10 and 11. A second conical drum member 17 abuts against a shoulder 18 of the shaft section 10 and is held in place by means of a holding ring 19 mounted on the shaft section 10. The drum members 15 and 17, together with the periphery of the shaft section 10, define a tapered centrifuging chamber 21. The gap between the drum members 15 and 17 forms an expelling or ejecting gap 20 which is in communication with an outer ring chamber 22 and an ejection chute 23 arranged on the lower part of the centrifuge. The ring chamber 22 and ejection chute 23 are rigidly mounted in a housing 24 which is supported on the A-frames 3 of the centrifuge.

Figure 1B:
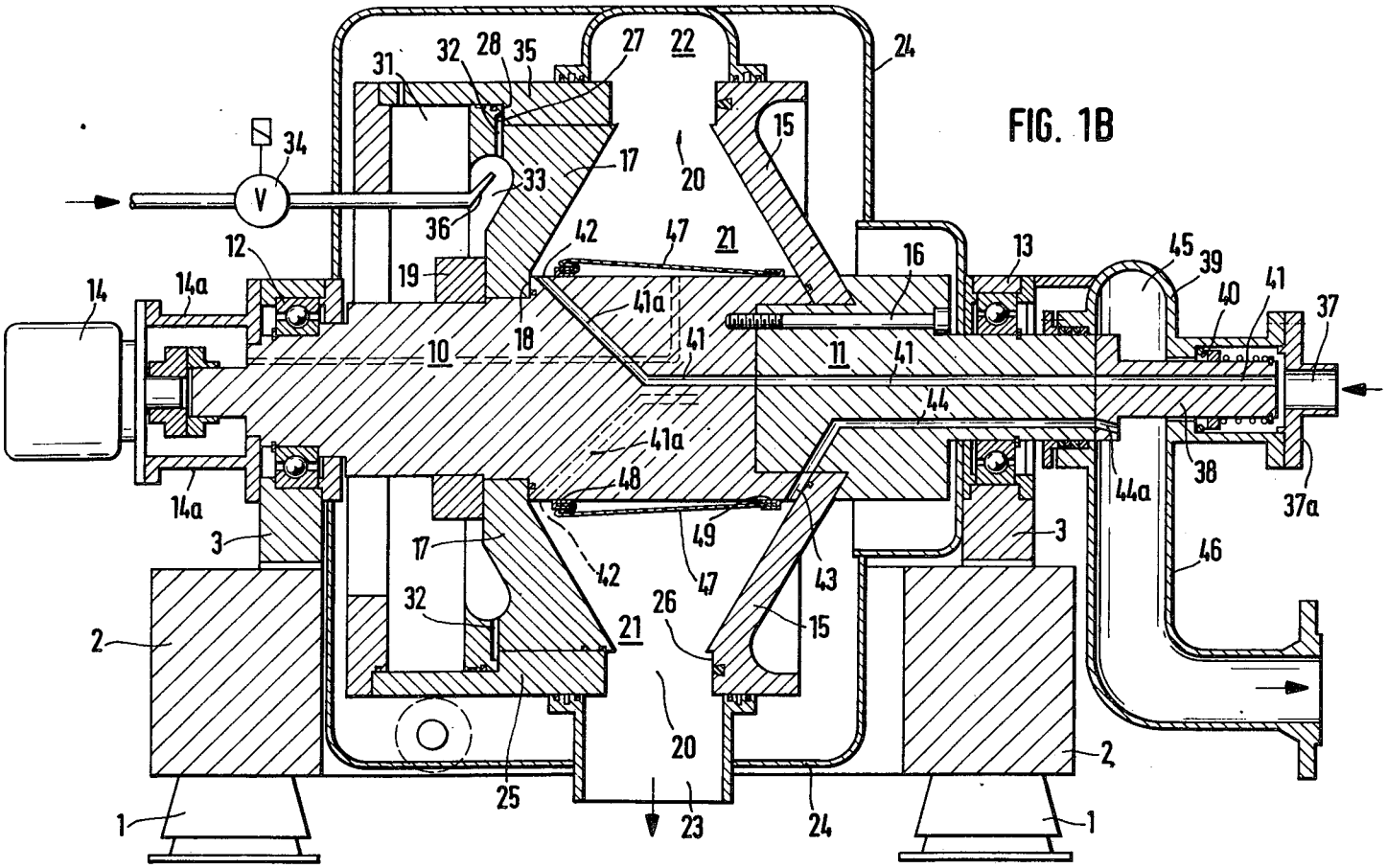
FIG. 1B is a schematic central longitudinal section similar to FIG. 1A wherein the centrifuging chamber is open.

The ejection gap 20 of the centrifuge can be closed by means of a hollow cylindrical member 25, which is illustrated for clarity's sake in FIG. 1A in a closed position and in FIG. 1B in an open position. The hollow cylindrical member 25 is axially slidably mounted on the outer cylindrical surface of the conical drum member 17 between two end positions which are determined on the one hand, by the contact of the hollow cylindrical member 25 against a ring surface 26 of the conical drum member 15 and, on the other hand, by contact with the shoulder 27 of the hollow cylindrical member 25 and a ring surface 28 of the conical drum member 17.

The adjustment of the hollow cylindrical member 25 is effected by hydraulic actuating means. For this purpose there are arranged, between the hollow cylindrical member 25 and a ring 29 connected therewith and the conical drum member 17 which is rigidly mounted on the shaft section 10, two cylindrical chambers 30 and 31. The cylindrical chamber 30 is in direct communication via a radial bore 32 disposed in the drum member 17 and which communicates the chamber 30 with the ring chamber 33. Similarly the cylindrical chamber 31 is in direct communication with the ring chamber 33. Hydraulic liquid, for example tap water, is sprayed into the ring chamber 33 via a conduit 35, having a valve 34 and terminating in an inclined nozzle 36. The hydraulic liquid, which is sprayed into the ring chamber 33, can be supplied at relatively low pressure such as a house water line. This liquid is conducted from the ring chamber 33 through the radial bores 32 outwardy into the cylindrical chamber 30 by virtue of the centrifugal forces acting on the liquid during the rotation of the centrifuge. This pressure is sufficient to move the hollow cylindrical member 25 in an axial direction into its closed position as illustrated in FIG. 1A, particularly in view of the fact that the hollow cylindrical member 25 is not biased in an axial direction.

In the event the hollow cylindrical member 25 is in its closed position and a larger volume of hydraulic fluid is supplied via the nozzle 36, then this hydraulic fluid moves from the ring chamber 33 by virtue of the effect of the centrifugal forces into the cylindrical chamber 31 and causes thereby a sliding of the hollow cylindrical body 25 into its open position as illustrated in FIG. 1B. This is possible by accurately sizing the effective pressure surfaces on the hollow cylindrical member 25 to adjustably move the member 25 into its closed and open position without any operational difficulties.

The to be treated liquid/solid matter mixture is conducted via a coaxial conduit 37 into a housing 37*a* which is coaxially mounted at one end of the centrifuge in alignment with a shaft head 38, the latter being rigidly secured to the shaft section 11. A connecting housing 39 is mounted around the shaft head 38 and forms an extension of the housing 37*a* as illustrated in FIGS. 1A and 1B. The assembly of the housing 39 and conduit 37*a* is supported on the A-frame 3. Packings 40 serve to seal the conduit 37*a* relative to the space defined by the connecting housing 39. The shaft head 38 and the shaft sections 10 and 11 are provided with a plurality of mixture supply channels 41 which are uniformly spaced in a small circle around the axis of the shaft. For clarity's sake only one supply mixture channel 41 is illustrated in FIGS. 1A and 1B. Each mixture channel 41 ends in an outwardly inclined channel 41*a* having an outlet opening 42 in the shaft section 10. The outlet opening 42 is closely spaced from the drum member 17 in the centrifuging chamber 21. The liquid/solid matter mixture flows over the entire length of the centrifuging chamber 21. During this flowing process the solid materials are flung against both drum members and the inner surface of the hollow cylindrical member 25 in a known manner. The cleared liquid exits thereafter via the clear liquid inlet openings 43 which are located immediately adjacent to the drum member 15 in the shaft section 10. the inlet openings 43 are in communication with outlet openings 44*a* of the conduits 44 extending through shaft sections 10 and 11. The outlet conduits 44 (only one of which is illustrated in FIGS. 1A and 1B for clarity's sake) are disposed around a circle centered on the axis of the centrifuge which is larger than the circle defined by channels 41. The outlet openings 44*a* thus provide a flow of clarified liquid, around a circle larger than the circle on which the channels 41 are disposed, into the outlet chamber 45 in the connecting housing 39. As can be noted, the conduits 44 are slightly inclined radially outwardly in the region of the outlet openings 44*a* thereof. This inclination enables the centrifugal forces to create a suction effect in the outlet conduits 44. The cleared liquid is therefore normally sucked out of the centrifuging chamber 21.

As can be noted from FIG. 1A the shaft section 10 is provided in the region of the centrifuging chamber 21 with a flexible ring collar 47, one end of which is firmly held onto the peripheral surface of the shaft section 10 by means of clamping rings 49. The other end of which is slidably mounted on the peripheral surface of the shaft section 10 by means of clamping ring 48. The ring collar 47 can be pneumatically or hydraulically moved from an inoperative position, illustrated in FIG. 1A, into an expanded position illustrated in FIG. 1B. The supply of pressurized air or hydraulic fluid is carried out via one or a plurality of channels which may be disposed in shaft section 10 and/or shaft section 11. Only one channel is illustrated for sake of clarity. The flexible collar 47 is expanded shortly before opening the centrifuging chamber 21 so that it covers in its expanded condition the outlet openings 42 of the conduits 41, (see FIG. 1A) whereas the inlet openings 43 remain exposed. By virtue of this expanded collar 47, it is possible before opening the centrifuging chamber 21 to remove all of the remaining liquid therein, so that when the centrifuging chamber 21 is opened only the expelled solid material and not any remaining clear liquid is removed via the ejecting chute 23.

The adjustment of the hollow cylindrical member 25 can also be carried out by different adjusting mechanisms. For example, the adjustment can be mechanically carried out by means of a drive motor, which rotates jointly with the shaft, and which is arranged on a non-illustrated adjustment spindle. However, the preferred hydraulic automatic adjustment of the hollow cylindrical member 25 can also be carried out by means of two cylindrical chambers which are completely separated from each other and are supplied by separate conduits with a pressure medium, said conduits supplying pressure medium in opposite axial directions to the respective cylindrical chambers.

Figure 2:
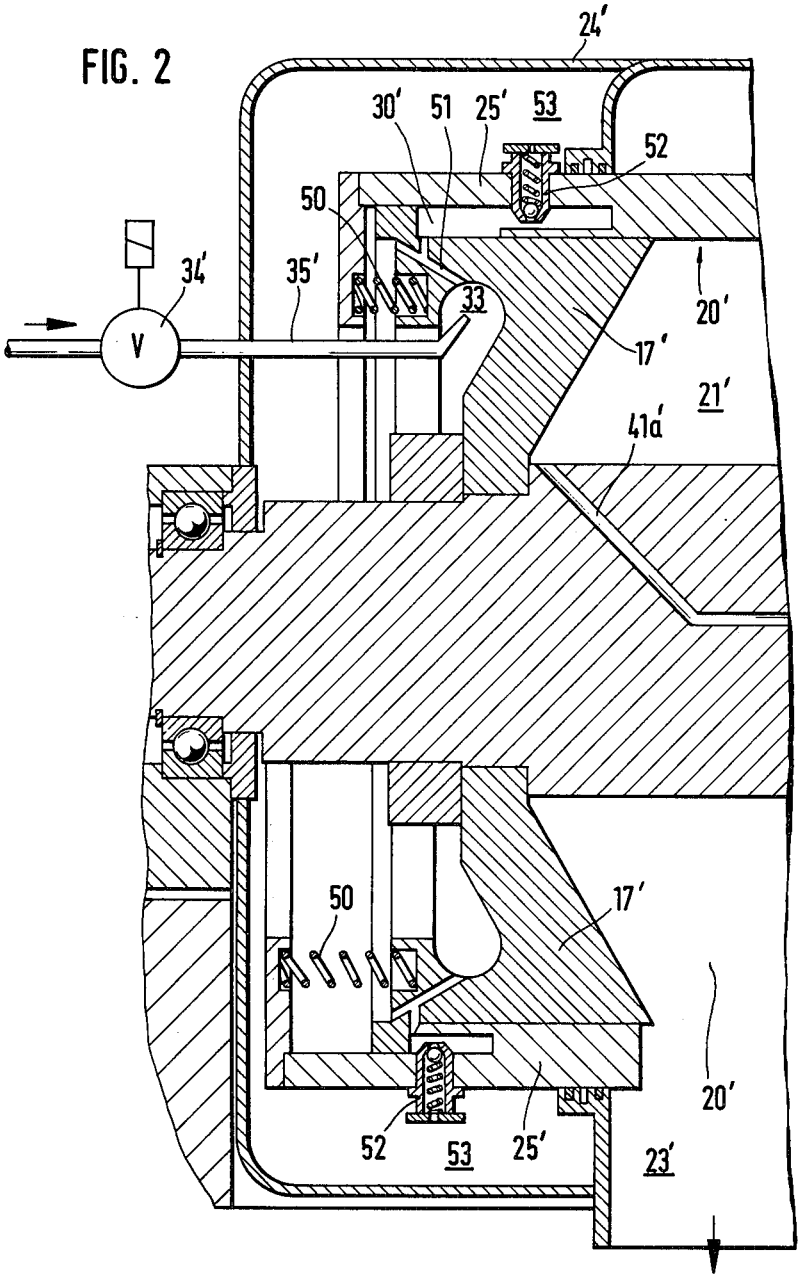
FIG. 2 is a partial sectional view of a second embodiment of a centrifuge in accordance with the invention.

FIG. 2 illustrates a further possible embodiment of an adjustment mechanism. All parts which are equivalent to the parts of the arrangement of FIGS. 1A and 1B have the same reference numbers as the parts of the arrangement of FIG. 2 with the suffix (') prime added to them. In this embodiment the hollow cylindrical member 25' is biased in one direction by means of a plurality of coil springs 50 arranged uniformly along the periphery of the centrifuge which urge the cylindrical member 25' into an open position. The closing of the hollow cylindrical member 25' is effected against the force exerted by the coil springs 50 by having pressure fluid flowing from the ring chamber 33' via channels 51 of the conical drum member 17' into the cylindrical chamber 30'. The cylindrical chamber 30' is in communication with the space in the housing 53 of the centrifuge via at least one one-way valve 52. The conical drum members 15' and 17' can be secured on the shaft by spacing rings (not illustrated); such spacing rings can be used to change the distance between the drum members and thereby also the width of the expelling gap 20' and the volume of the centrifuging chamber 21'. The hollow cylindrical member 25' will, in such an embodiment, be constructed with a suitable length so that it can bridge different widths of expelling gaps 20'.

It should be noted that the drum members and the hollow cylindrical member can, preferably, be made of fiber glass-reinforced plastic materials.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. A centrifuge for separating and/or thickening liquid/solid mixtures, comprising in combination, a support frame;

horizontal shaft means rotatably mounted in said support frame and having at least one first liquid/solid mixture supply conduit and at least one second clarified liquid outlet conduit disposed therein;

a drive motor operatively connected to said shaft means for rotating it;

two conical drum members axially rigidly mounted on said shaft means in spaced relationship to each other;

the respective outlet of said first conduit and the inlet of said second conduit being disposed on said shaft means between said two conical drum members;

a hollow cylindrical member axially slidably mounted on one of said two conical drum members and movable between a fully open and a closed position on one of said two conical drum members;

said shaft means and two conical drum members define a centrifuging chamber therebetween which can be opened or closed by the axial movement of said hollow cylindrical member;

said horizontal shaft means has a diameter which is at least a third of the maximum diameter of said centrifuging chamber.

2. The centrifuge as defined in claim 1, wherein said two conical drum members respectively have opposite stop surfaces which limit the axial movement of said hollow cylindrical member.

3. The centrifuge as defined in claim 1, wherein at least one holding ring is axially mounted on said shaft means for securing at least one of said two conical drum members in position on said shaft means.

4. The centrifuge as defined in claim 1, wherein said first one of said two conical drum members and said hollow cylindrical member define a first pressure chamber therebetween,and pressure fluid conduit means mounted in said support frame for selectively supplying pressure fluid to said first pressure chamber to axially slidably move said hollow cylindrical member on said first conical drum member.

5. The centrifuge as defined in claim 1, wherein said first one of said two conical drum members at least partially and said hollow cylindrical member define first and second pressure chambers therebetween, said first and second pressure chambers acting in mutually opposite directions and have different axial pressure surfaces, and pressure fluid conduit means mounted in said support frame for selectively supplying pressure fluid to said first and second pressure chambers to axially slidably move said hollow cylindrical member on said first conical drum member.

6. The centrifuge as defined in claim 5, wherein said first and second pressure chambers have radially inward positioned outlet openings in communication with said pressure fluid conduit means.

7. The centrifuge as defined in claim 1, including a flexible expandable collar axially mounted on said shaft means in said centrifuging chamber and adapted to reduce the volume of said centrifuging chamber.

8. The centrifuge defined in claim 7, wherein said expandable collar is adapted to cover only said outlet opening of said mixture supply conduit in said centrifuging chamber when expanded, whereby said inlet opening of said liquid outlet conduit remains exposed.

9. The centrifuge as defined in claim 1, wherein said two conical drum members are made of welded steel.

10. The centrifuge as defined in claim 1, wherein said two conical drum members and said hollow cylindrical member are made of filber-glass reinforced plastic material.

11. The centrifuge as defined in claim 5, including a plurality of coil springs mounted between said hollow cylindrical member and said first conical drum member and urging said hollow cylindrical member into the open position.

12. The centrifuge as defined in claim 5, wherein the position of said hollow cylindrical member on said first conical drum member is automatically adjusted, including one way valve means mounted on said hollow cylindrical member and being in communication with one of said two pressure chambers, whereby the pressure in said one pressure chamber is automatically adjusted in accordance with the rotational speed of said shaft means.

* * * * *